US007104872B1

(12) United States Patent
Koch

(10) Patent No.: US 7,104,872 B1
(45) Date of Patent: Sep. 12, 2006

(54) SANDBLASTING CABINET

(76) Inventor: David Koch, 3111 Ponderosa Dr., Allison Park, PA (US) 15101

( * ) Notice: Subject to any disclaimer, the term of this patent is extended or adjusted under 35 U.S.C. 154(b) by 0 days.

(21) Appl. No.: 11/213,060

(22) Filed: Aug. 29, 2005

(51) Int. Cl.
*B24C 9/00* (2006.01)

(52) U.S. Cl. ..... 451/89; 451/87

(58) Field of Classification Search ..... 451/89, 451/75, 90, 38, 87
See application file for complete search history.

(56) References Cited

U.S. PATENT DOCUMENTS

| | | | | |
|---|---|---|---|---|
| 4,404,782 | A * | 9/1983 | Williams et al. | 52/475.1 |
| 5,038,527 | A * | 8/1991 | Fastje | 451/89 |
| 5,460,564 | A * | 10/1995 | Bowes et al. | 451/89 |
| 5,823,860 | A * | 10/1998 | Lynn et al. | 451/89 |
| 6,099,395 | A * | 8/2000 | Guseman | 451/75 |
| 6,712,677 | B1 * | 3/2004 | Williams et al. | 451/89 |

FOREIGN PATENT DOCUMENTS

| | | | | |
|---|---|---|---|---|
| DE | 2303055 | * 12/1973 | | 451/89 |
| FR | 1245332 | * 9/1960 | | 451/89 |
| WO | WO 2005/120777 | * 12/2005 | | 451/89 |

* cited by examiner

*Primary Examiner*—Robert A. Rose
(74) *Attorney, Agent, or Firm*—Glenn E. Klepac

(57) ABSTRACT

A sandblasting cabinet including side walls, a top wall, and a bottom wall, wherein at least one wall is made from corrugated cardboard or corrugated plastic sheet. The side walls, top wall, and bottom wall are preferably made from a first sheet of corrugated plastic. In a preferred embodiment the cabinet also includes a deflector shield including a sloped wall extending between the top wall and a side wall. The deflector shield is preferably made from a second sheet of corrugated cardboard or corrugated plastic. A kit for making the sandblasting cabinet preferably includes the first and second sheets and two additional side insert sheets made from corrugated cardboard or corrugated plastic.

17 Claims, 5 Drawing Sheets

SANDBLASTING CABINET

FIELD OF THE INVENTION

The present invention relates to a sandblasting cabinet, a kit for making the cabinet, and a method of sandblasting utilizing the cabinet after it is assembled.

BACKGROUND OF THE INVENTION

The present invention relates to abrasive systems and more particularly to a light weight collapsible sandblasting cabinet for use in abrading various articles, the abrading process being performed inside the cabinet.

In the prior art abrasive particles such as sand have been used to remove surface portions of various articles. The sand is propelled against the workpiece surface in a stream of high velocity air which carries the sand. Impingement of the sand against the workpiece surface wears away a top layer of the workpiece, producing dust. Unless the used sand and dust are confined they will be scattered and wasted and they will contaminate the environment. Accordingly enclosures of various types are used to contain the sand so that it can be reused and to avoid detrimental environmental effects. The enclosure must be large enough to contain the articles to be abraded and to permit viewing by an operator while abrasion is taking place. Additionally the enclosure generally provides arm holes fitted with gloves so that an operator may manipulate the work being abraded. These requirements make for an intricate design so that prior art cabinets made from metal, plastic, or glass panels are relatively expensive. Most prior art cabinets are large enough and sufficiently heavy to make transportation an expensive proposition. Accordingly there still remains a need for an inexpensive sandblasting cabinet that is light and collapsible into a compact shape so that it can be folded up and then transported and stored easily and inexpensively.

Sandblasting cabinets are disclosed in various existing patents including Numemaker U.S. Pat. No. 3,599,375 for "Sand-Blasting Device"; Brown U.S. Pat. No. 4,375,740 for "Portable Abrading Cabinet Device for Recycling Abrasive Blasting System"; Bowes et al. U.S. Pat. No. 5,460,564 for "Sandblasting Cabinet Assembly"; Guseman U.S. Pat. No. 6,099,395 for "Collapsible Sandblasting Cabinet"; and Williams et al. U.S. Pat. No. 6,712,677 for "Portable Sand Blasting Cabinet and Accessory End Caps". The disclosures of these patents are incorporated herein, to the extent consistent with the present invention. However, the prior art sandblasting cabinets includes one or more serious deficiencies making them less than entirely suitable for their intended purpose.

A principal objective of the present invention is to provide an inexpensive and light weight sandblasting cabinet by making at least one wall of the cabinet from corrugated plastic or corrugated cardboard sheet material. Another objective of the present invention is to provide a sandblasting method including assembly of a sandblasting cabinet from a kit comprising sheets of corrugated plastic or corrugated cardboard sheet material. A related objective of the invention is to assemble a sandblasting cabinet from a kit containing the sheets, utilizing hook and loop fasteners to connect side wall flaps. Additional objectives and advantages of my invention will become apparent to persons skilled in the art from the following detailed description of a particularly preferred embodiment.

SUMMARY OF THE INVENTION

In accordance with the present invention there is provided a sandblasting cabinet for containing an abrading device and a workpiece to be abraded by abrasive particles emanating from the device. The abrading device is preferably a sandblasting gun. The sandblasting cabinet includes side walls and a top wall. A first side wall defines at least one arm hole to be used for manipulating articles inside the cabinet. The first side wall also defines a window opening covered by a sheet of transparent material. A second side wall or rear wall defines an exhaust port for removing dust from within the cabinet. The top wall or a side wall defines an opening for a light illuminating the workpiece and the sandblasting gun. The cabinet preferably includes 4 side walls joined with the top wall to define a blasting chamber. At least one wall selected from the side walls and the top wall comprises a corrugated cardboard sheet or a corrugated plastic sheet. Corrugated plastic is particularly preferred. The corrugated plastic may be polyethylene, polypropylene, a polyethylene-polypropylene copolymer, a blend of polyethylene with polypropylene, or polyvinyl chloride. Polyethylene is particularly preferred. The cabinet preferably also includes a bottom wall or floor comprising a corrugated cardboard sheet or a corrugated plastic sheet. In a particularly preferred embodiment the 4 side walls, top wall, and bottom wall are formed integrally from a first sheet of corrugated cardboard or corrugated plastic.

Adjacent top flaps and bottom flaps on the side walls are preferably connected by hook fasteners and loop fasteners. The fasteners are adhesively joined to the side walls. The exhaust port is connected to a vacuum source to remove dust particles from the blasting chamber. A deflector shield inside the chamber deflects abrasive particles away from the exhaust port. The deflector shield extends downwardly from the top wall and rearwardly. The deflector shield preferably extends between the top wall and the second side wall, preferably to a location on the second side wall below the exhaust port. A kit for making the sandblasting cabinet of the invention includes a first sheet of corrugated plastic making up the side wall flaps, top wall, and bottom wall; and a second sheet of corrugated plastic making up the deflector shield. The kit preferably also includes two additional side insert sheets. The kit preferably includes 4 corrugated plastic sheets altogether.

The invention moreover contemplates a method of sandblasting comprising assembling the sandblasting cabinet from a kit as described above; positioning inside the cabinet an abrading device and a a workpiece to be abraded; and spraying abrasive particles from the abrading device toward the workpiece, thereby removing from the workpiece a portion thereof. For example the abrading device removes a layer of rust from iron and steel articles. The method of the invention preferably also includes steps of manipulating the workpiece manually through at least one arm hole; illuminating the workpiece through an opening in the top wall; viewing the article through the window; deflecting abrasive particles inside the blasting chamber by means of a downwardly and rearwardly sloped deflector shield; and exhausting dust from the blasting chamber through the exhaust port.

DETAILED DESCRIPTION OF A PREFERRED EMBODIMENT

Figure 1:
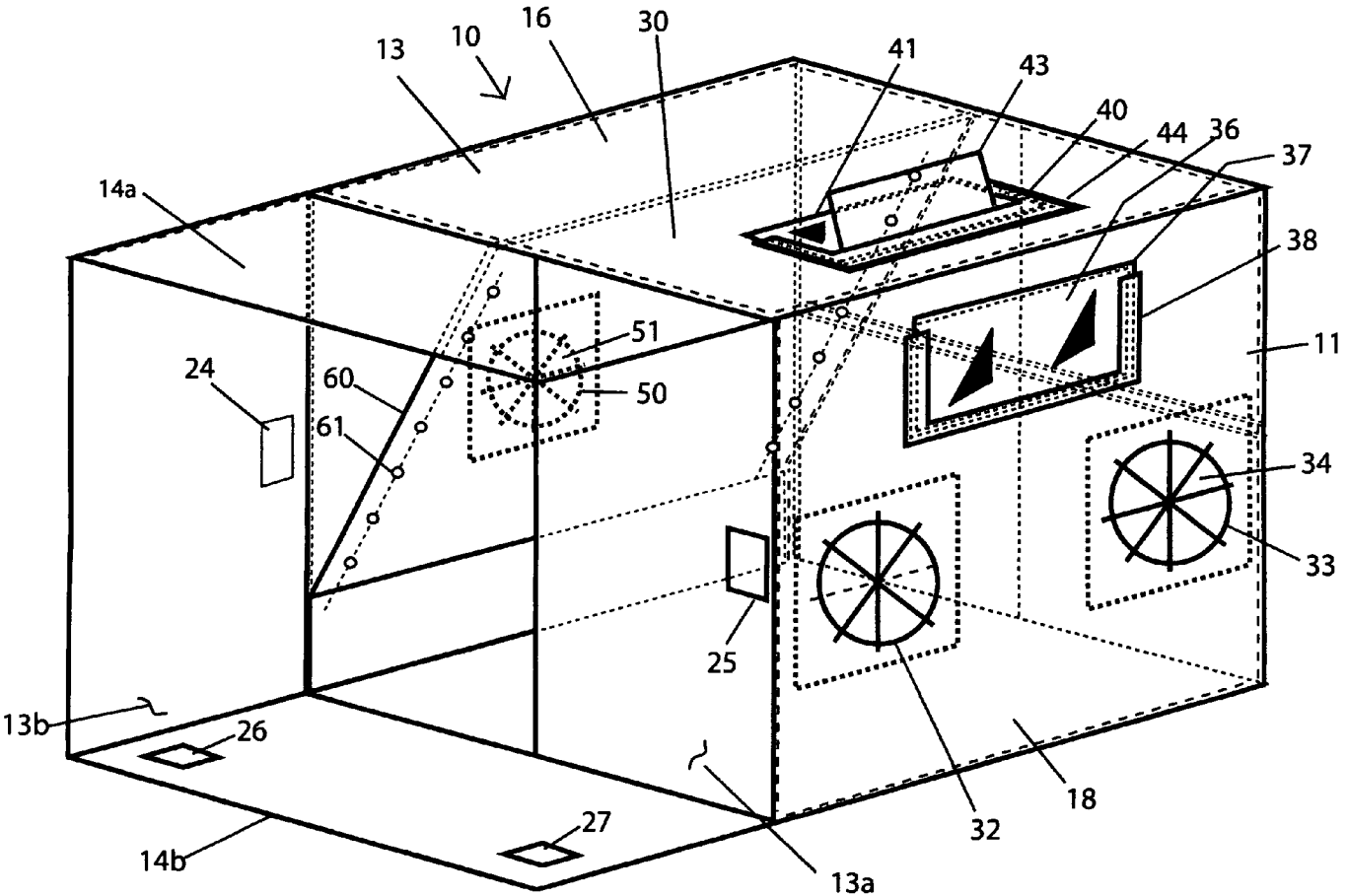
FIG. 1 is a perspective view of a sandblasting cabinet of the invention.

A particularly preferred embodiment of a sandblasting cabinet 10 of the invention is shown in FIGS. 1–5. Referring more particularly to FIG. 1, the cabinet 10 has side walls including a front wall 11, a rear wall 12, and left and right side wall flaps 13*a*, 13*b*, 14*a*, 14*b* extending between the front wall 11 and the rear wall 12. A top wall 16 and a bottom wall 18 are formed integrally with the side walls. The left and right side wall flaps each include a front interior flap 13*a* folded rearwardly of the front wall 11; a rear interior flap 13*b* folded forwardly of the rear wall 12; a top exterior flap 14*a* folded downwardly from the top wall 16; and a bottom exterior flap 14*b* folded upwardly from the bottom wall 18. The exterior flaps 14*a*, 14*b* are adhered to two spaced hook fasteners 24, 25, both joined to loop fasteners 26, 27 on respective front and rear interior flaps 13*a*, 13*b*. The hook fasteners 24, 25 and the loop fasteners 26, 27 are attached by an adhesive to their respective flaps. The side walls 11, 12, 13*a*, 13*b*, 14*a*, 14*b*; top wall 16; and bottom wall 18 are preferably constructed from a single sheet of corrugated plastic material. The cabinet 10 also includes a first side insert panel 28 adjacent the left side wall interior flaps 13*a*, 13*b* and a second side insert panel 29 adjacent the right side wall interior flaps 13*a*, 13*b*. Together, the top wall 11, bottom wall 12, side wall flaps 13*a*, 13*b*, 14*a*, 14*b*, and the left and right side insert panels 28, 29 define a blasting chamber 30 inside the cabinet 10.

Figure 2:
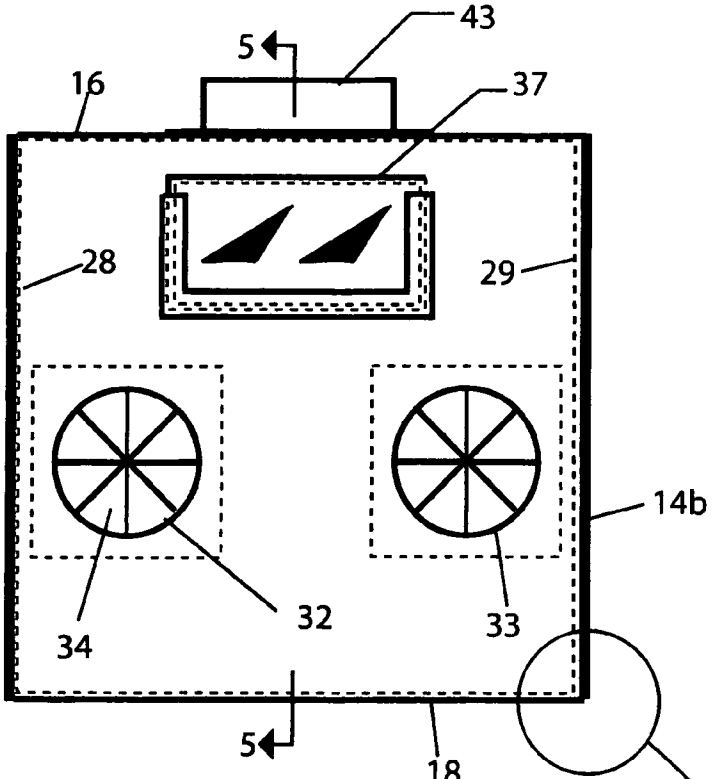
FIG. 2 is a front elevational view of the sandblasting cabinet of FIG. 1.

Referring now to FIG. 2, the front wall 11 defines a left hand port 32 and a right hand port 33. Each hand port 32, 33 supports a flexible diaphragm 34 allowing a user's hand to slip through the ports 32, 33 for manipulation of a workpiece inside the blasting chamber 30. The front wall 11 also defines a window opening 36 covered by a sheet 37 of transparent material supported by a frame 38 attached to the wall 11. The transparent material may be plastic or glass and is preferably a transparent polycarbonate. The sheet 37 may be replaced as needed if it becomes cloudy after long periods of use.

Figure 3:
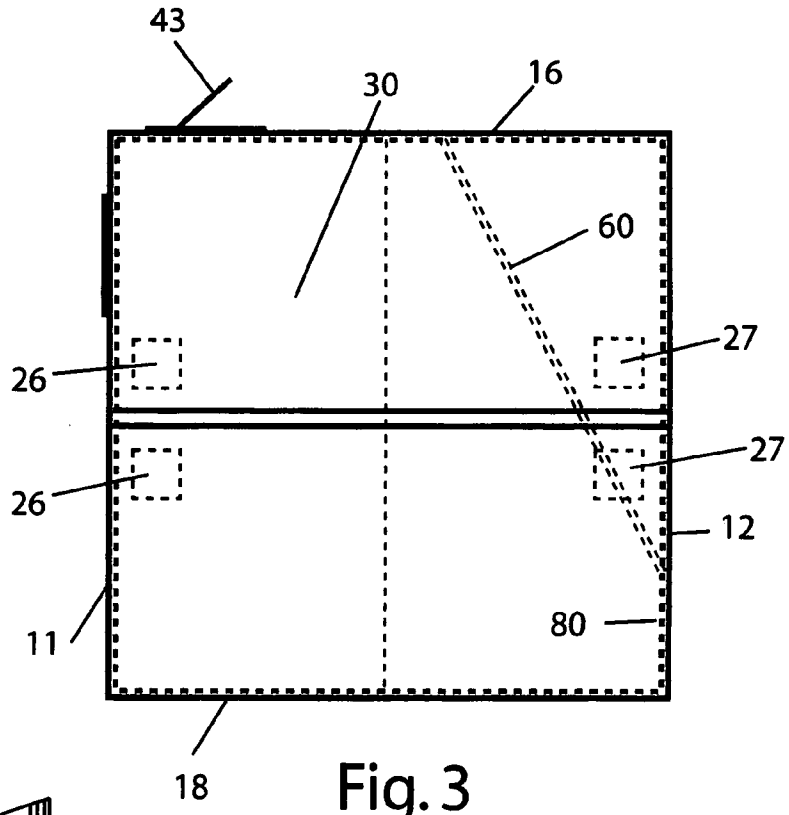
FIG. 3 is a side elevational view of the sandblasting cabinet of FIG. 1.
Figure 4:
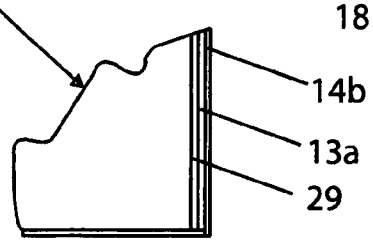
FIG. 4 is an enlarged fragmentary cross-sectional view of the sandblasting cabinet of FIG. 2.

Referring now to FIGS. 1, 2, and 3, the top wall 16 defines a generally rectangular opening 40 covered by a polycarbonate sheet 41. A light deflector 43 attached to the top wall 16 in front of the opening 40 extends upwardly and rearwardly. The deflector 43 reflects light from an electric lamp (not shown) downward through the opening 40 and shields an operator's eyes from such light. The polycarbonate sheet 41 is attached to a frame 44 so that the sheet can be replaced if it loses transparency after use.

Referring now to FIG. 1, the rear wall 12 defines a generally circular vacuum port or exhaust port 50 covered by a rubber diaphragm 51. The exhaust port 50 communicates with a conduit (not shown) connected to a vacuum source, for evacuating dust from the blasting chamber 30.

Figure 5:
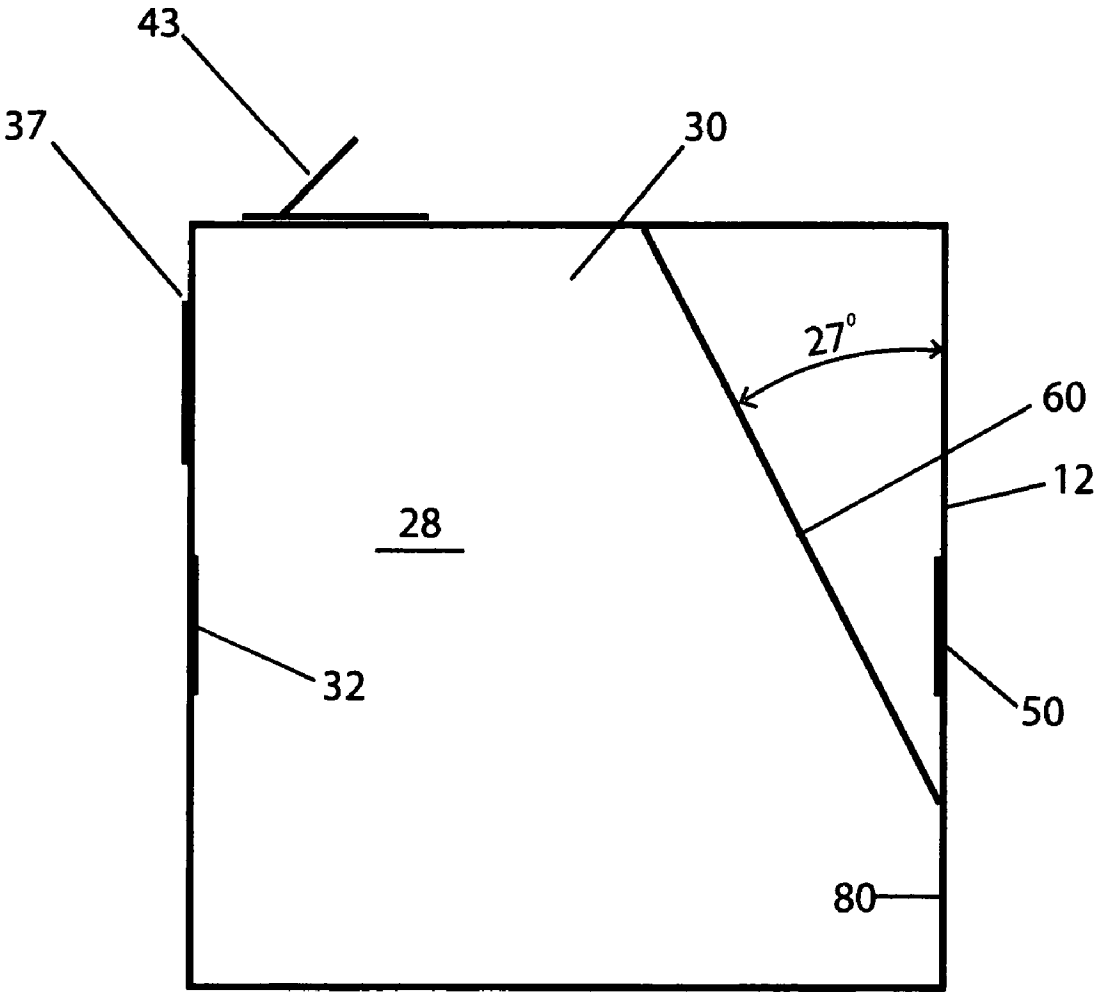
FIG. 5 is a cross-sectional view taken along the lines 2—2 of FIG. 2.

Referring to FIGS. 1, 3, and 5, the cabinet 10 also includes a deflector shield or deflector insert 60 inside the blasting chamber 30. The deflector shield 60 defines 2 sets of laterally spaced dust collection holes 61 allowing passage of fine dust while larger abrasive granules settle to the bottom of the chamber 30 for later collection. Placement of the dust collection holes 61 at lateral ends of the shield 60 prevents air from flowing in a straight path from the chamber to the exhaust port 50. The deflector shield 60 extends downwardly from the top wall 16 at a 27° angle to the rear wall 12, as shown in FIG. 5.

Figures 6, 7:
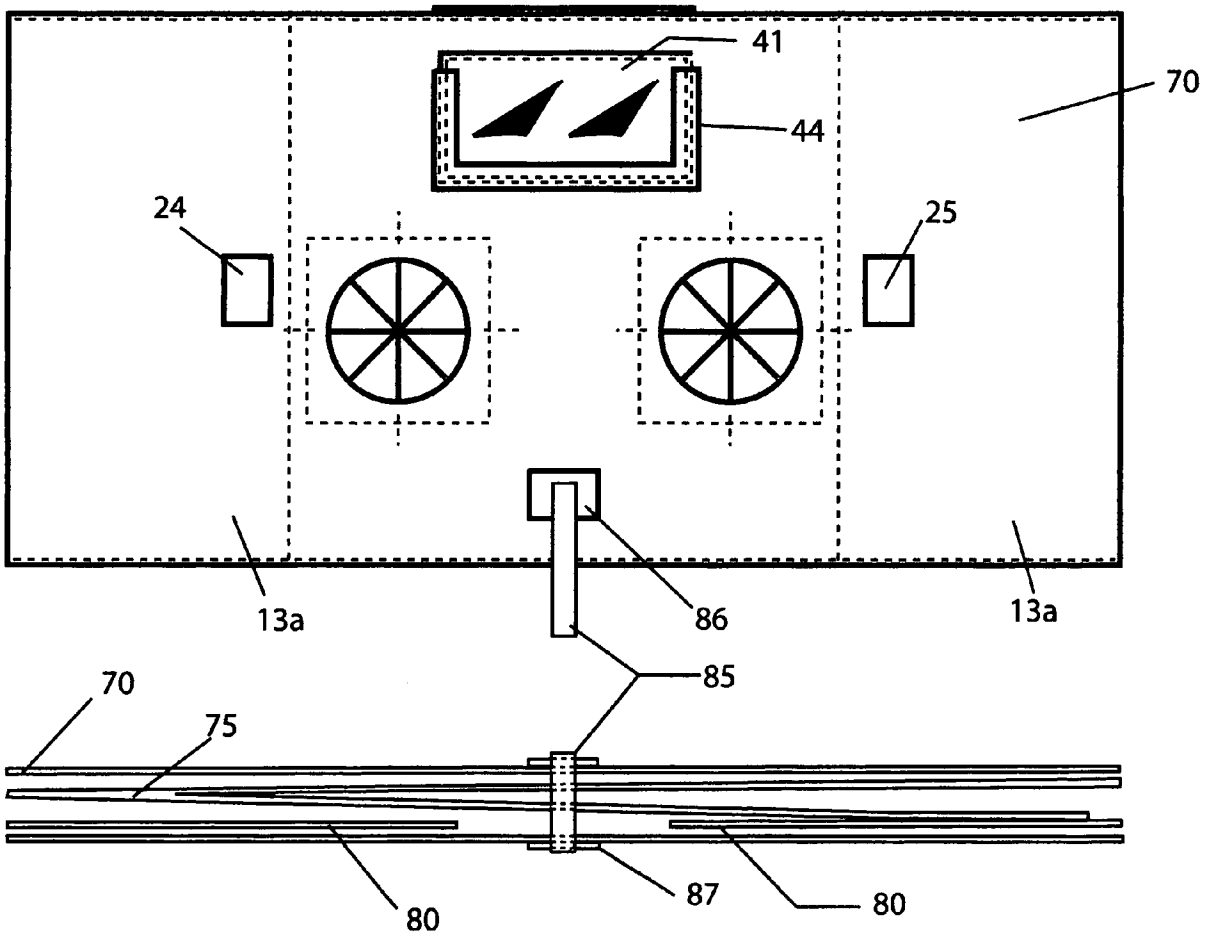
FIG. 6 is a front elevational view of a kit for making a sandblasting cabinet.
FIG. 7 is a top elevational view of the kit of FIG. 6.
Figure 8:
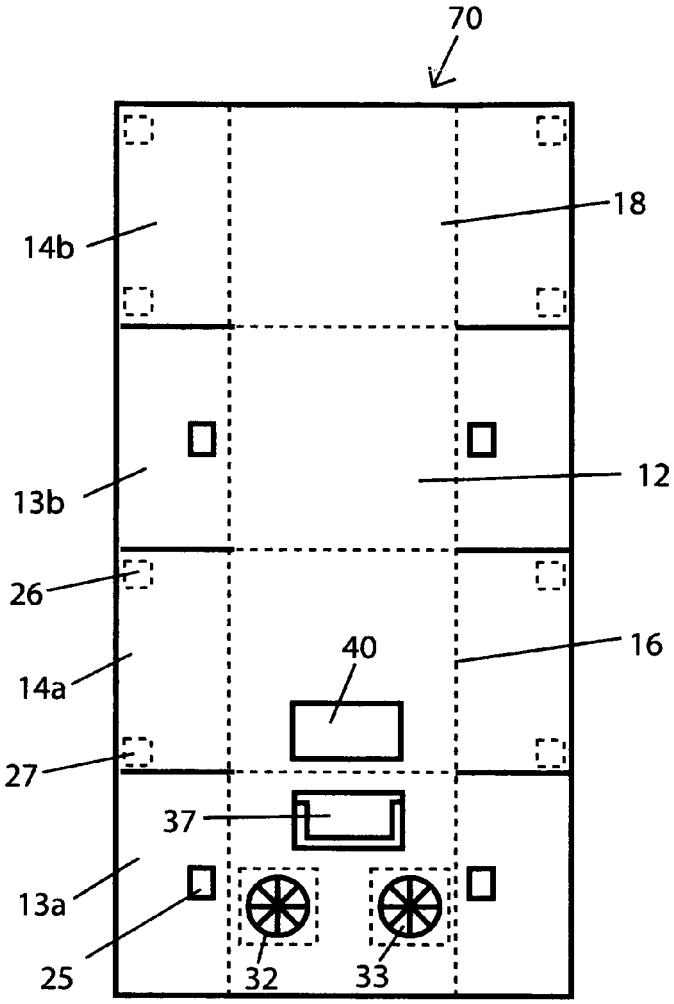
FIG. 8 is a top plan view of a first sheet of corrugated plastic.
Figure 9:
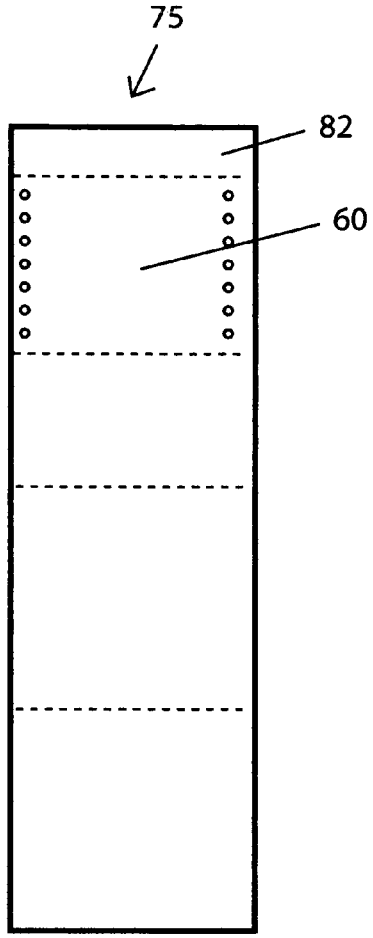
FIG. 9 is a top plan view of a second sheet of corrugated plastic.
Figure 10:
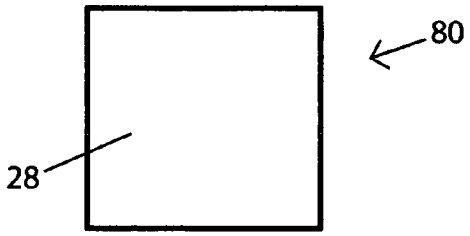
FIG. 10 is a top plan view of a side insert panel.

Referring now to FIGS. 6–10, a kit 65 for making the sandblasting cabinet of the invention includes a first sheet 70; a second sheet 75; and two third sheets 80. All 4 sheets are preferably made from corrugated plastic. The first sheet 70 includes the front wall 11, rear wall 12, top wall 16, bottom wall 18, and side flaps 13*a*, 13*b*, 14*a*, 14*b*. The second sheet 75 includes the deflector shield 60 and a rear support wall 82 supporting a lower end of the shield 60 upwardly of the bottom wall 14, as shown in FIGS. 1 and 3. The third sheets 80 make up the side inserts 28, 29. As shown in FIGS. 6 and 7, the kit 65 is easily collapsed into a compact, light weight package. The second sheet 75 and two third sheets 80 are contained inside a folded first sheet 70 for making the cabinet body. Opposed lower end portions of the first sheet 70 are held together by a handle 85 containing loop fasteners releasably attached to hook fasteners 86, 87 adhered to opposite sides of the first sheet 70.

PARTS LIST

10 Sandblasting cabinet
11 Front wall
12 Rear wall
13*a* Front interior flap
13*b* Rear interior flap
14*a* Top exterior flap
14*b* Bottom exterior flap
16 Top wall
18 Bottom wall
24,25 Hook fasteners
26,27 Loop fasteners
28 First side insert panel—left side
29 Second side insert panel—right side
30 Blasting chamber
32 Left hand port
33 Right hand port
34 Flexible diaphragm
36 Window opening
37 Sheet of transparent material
38 Frame
40 Opening
41 Polycarbonate sheet
43 Light reflector
44 Frame
50 Exhaust port
60 Deflector shield
61 Dust collector holes
65 Kit for making the sandblasting cabinet
70 First sheet
75 Second sheet
80 Third sheet
82 Rear support wall
85 Handle The foregoing detailed description of my invention has been provided with reference to one particularly preferred embodiment. Persons skilled in the art understand that numerous modifications can be made in my invention without materially departing from the spirit and scope of the following claims.

The invention claimed is:

1. A sandblasting cabinet for containing an abrading device delivering a spray of abrasive particles toward a workpiece to be abraded, said cabinet comprising:

(a) a first side wall defining at least one arm hole and a window covered by a sheet of a transparent material, (b) a second side wall defining an exhaust port for removing dust from within said cabinet, (c) a top wall, said top wall or a side wall defining an opening for illuminating a workpiece to be abraded while said workpiece is contained within said cabinet, and (d) a bottom wall, wherein said side walls and said top wall are joined together to define a blasting chamber and said first and second side walls, said top wall, and said bottom wall are formed integrally from a single sheet of corrugated cardboard sheet or a corrugated plastic sheet.

2. The sandblasting cabinet of claim 1 comprising 4 side walls between said top wall and said bottom wall.

3. The sandblasting cabinet of claim 2 further comprising side wall flaps connected with each other by hook and loop fasteners.

4. The sandblasting cabinet of claim 3 wherein said side wall flaps, said top wall, and said bottom wall each comprise corrugated plastic.

5. The sandblasting cabinet of claim 4 wherein said top wall, said side walls, and said bottom wall are formed integrally of a single sheet having fold lines between said top wall and said side walls and between said side walls and said bottom wall.

6. The sandblasting cabinet of claim 1 further comprising:

(e) a deflector shield inside said blasting chamber, said deflector shield comprising a sloped wall extending between said top wall and said second side wall.

7. The sandblasting cabinet of claim 5 wherein said corrugated plastic comprises a polymer selected from the group consisting of polyethylene, polypropylene, polyethylene-polypropylene copolymers, and blends of polyethylene and polypropylene.

8. A kit for making a sandblasting cabinet comprising a first sheet of corrugated plastic including the side walls, top wall, and bottom wall of claim 2, and a second sheet of corrugated plastic including a deflector shield for placement inside the blasting chamber.

9. The kit of claim 8, further comprising first and second side insert panels extending between the first and second side walls inside the blasting chamber.

10. A sandblasting cabinet for containing an abrading device delivering a spray of abrasive particles toward a workpiece to be abraded inside said cabinet, said cabinet comprising:

(a) at least two side walls, at least one of said side walls defining an arm hole, at least one of said side walls including a window for viewing an abrading device inside said cabinet and an article to be abraded, and at least one of said side walls defining an exhaust port for removing dust from inside the cabinet;

(b) a top wall joined to each said side walls, and (c) a bottom wall joined to each said side walls, and (d) opposed side wall flaps formed integrally with said top wall and said bottom wall from a single sheet of corrugated cardboard sheet or a corrugated plastic sheet, said side wall flaps being joined to each other by hook fasteners and loop fasteners.

11. The sandblasting cabinet of claim 10 wherein said sheet includes fold lines between the top wall and the side walls.

12. The sandblasting cabinet of claim 10 further comprising a sloped deflector shield extending downwardly and rearwardly of said top wall.

13. The sandblasting cabinet of claim 10 wherein said side wall flaps, said top wall, and said bottom wall are formed integrally of a first sheet of corrugated plastic sheet material and further comprising a second sheet of corrugated plastic sheet material, said second sheet having fold lines, said second sheet including a deflector shield suitable for placement inside a blasting chamber defined by the side wall flaps, top wall, and bottom wall.

14. The sandblasting cabinet of claim 10 further comprising first and second side insert panels extending between the first and second side walls, said side insert panels each comprising a sheet of corrugated cardboard or corrugated plastic.

15. A method of sandblasting comprising:

(a) assembling a sandblasting cabinet from at least one sheet of corrugated plastic or corrugated cardboard sheet material, said cabinet including a top wall, side walls, and a bottom wall, said top wall, side walls, and bottom wall defining a chamber, said assembling of the sandblasting cabinet comprising folding said sheet along fold lines between the top wall and the side walls or between the bottom wall and the side walls, at least one of said side walls defining an arm hole, at least one of said side walls including a window covered by a sheet of transparent material, at least one of said side walls or said top wall defining an opening for a light illuminating a workpiece inside said cabinet, (b) positioning inside said cabinet a workpiece to be abraded and an abrading device for spraying abrasive particles, and (c) spraying abrasive particles from the abrasive device toward said workpiece, thereby removing from said workpiece a portion thereof.

16. The method of claim 15 further comprising:

(d) illuminating said workpiece through said opening and viewing said workpiece through said window.

17. The method of claim 15 wherein said top wall, bottom wall, and side walls each comprise corrugated plastic sheet material.

* * * * *